US009608359B2

(12) United States Patent
Arai et al.

(10) Patent No.: US 9,608,359 B2
(45) Date of Patent: Mar. 28, 2017

(54) WATERPROOF CONNECTOR WITH INTEGRATED SHELL AND CONTACT INTO HOUSING

(71) Applicant: Japan Aviation Electronics Industry, Limited, Tokyo (JP)

(72) Inventors: Katsumi Arai, Tokyo (JP); Masayuki Nishikata, Tokyo (JP); Masakazu Kobayashi, Tokyo (JP); Fumiki Yamada, Tokyo (JP); Hiroshi Akimoto, Tokyo (JP)

(73) Assignee: JAPAN AVIATION ELECTRONICS INDUSTRY, LIMITED, Tokyo (JP)

( * ) Notice: Subject to any disclaimer, the term of this patent is extended or adjusted under 35 U.S.C. 154(b) by 0 days.

(21) Appl. No.: 14/653,157

(22) PCT Filed: Nov. 26, 2013

(86) PCT No.: PCT/JP2013/081739
§ 371 (c)(1),
(2) Date: Jun. 17, 2015

(87) PCT Pub. No.: WO2014/103591
PCT Pub. Date: Jul. 3, 2014

(65) Prior Publication Data

US 2015/0333435 A1 Nov. 19, 2015

(30) Foreign Application Priority Data

Dec. 28, 2012 (JP) ..... 2012-286667
Mar. 22, 2013 (JP) ..... 2013-059809

(51) Int. Cl.
*H01R 13/40* (2006.01)
*H01R 13/52* (2006.01)
(Continued)

(52) U.S. Cl.
CPC ..... *H01R 13/5202* (2013.01); *H01R 12/716* (2013.01); *H01R 12/721* (2013.01);
(Continued)

(58) Field of Classification Search
CPC ..... H01R 13/5202
(Continued)

(56) References Cited

U.S. PATENT DOCUMENTS 4,830,630 A 5/1989 Dozier
5,433,628 A * 7/1995 Sadaishi ..... H01R 4/64 29/883
(Continued)

FOREIGN PATENT DOCUMENTS

CN 1942066 A 4/2007
CN 101120487 A 2/2008
(Continued)

*Primary Examiner* — Tulsidas C Patel
*Assistant Examiner* — Peter G Leigh
(74) *Attorney, Agent, or Firm* — Muncy, Geissler, Olds & Lowe, P.C.

(57) ABSTRACT

A waterproof connector is configured in such a manner that the waterproof properties between a housing and electrically conductive members, such as a shell and contacts, are improved. This waterproof connector includes a housing having an insulating resin and at least one electrically conductive member formed integrally with the housing. The electrically conductive member has a connection section which is exposed from the housing and connected to a mating connector, a mounting section which is exposed from the housing and mounted to a circuit board, and a holding section which connects the connection section and the mounting section, and which is embedded in the housing. A waterproof shaped section for blocking the entry of water along the interfaces between the holding section and the housing is formed on the surface of the holding section.

34 Claims, 13 Drawing Sheets

(51) Int. Cl.

| | |
|---|---|
| ***H01R 12/72*** | (2011.01) |
| ***H01R 12/71*** | (2011.01) |
| *H01R 24/60* | (2011.01) |
| *H01R 43/24* | (2006.01) |

(52) U.S. Cl.
CPC ..... *H01R 12/724* (2013.01); *H01R 13/521* (2013.01); *H01R 24/60* (2013.01); *H01R 43/24* (2013.01)

(58) Field of Classification Search
USPC ..... 439/76.1, 589
See application file for complete search history.

(56) References Cited

U.S. PATENT DOCUMENTS 5,978,226 A * 11/1999 Thomas ..... H05K 7/20854 361/707
6,958,674 B2 * 10/2005 Tsuchida ..... H01C 10/44 338/162
7,413,445 B2 * 8/2008 Inagaki ..... B60R 16/0239 439/76.1
8,092,252 B2 * 1/2012 Peng ..... H01R 12/724 439/352
8,657,609 B2 * 2/2014 Yanagisawa ..... H05K 5/0056 439/79
8,770,989 B2 * 7/2014 Ohhashi ..... H05K 5/0069 439/589
9,293,870 B1 * 3/2016 Koczwara ..... H01R 12/724
2003/0214382 A1 11/2003 Tsuchida
2004/0192117 A1 * 9/2004 Mott ..... H01R 13/04 439/736
2005/0047095 A1 * 3/2005 Tomikawa ..... H05K 3/284 361/715
2007/0134951 A1 * 6/2007 Inagaki ..... H05K 3/284 439/74
2007/0195504 A1 * 8/2007 Tomikawa ..... H05K 3/284 361/715
2008/0188108 A1 8/2008 Behr et al.
2012/0315779 A1 * 12/2012 Yudate ..... H01R 12/724 439/271
2013/0065442 A1 * 3/2013 Nagata ..... H01R 13/5202 439/607.58
2014/0248809 A1 * 9/2014 Onodera ..... H01R 13/03 439/884

FOREIGN PATENT DOCUMENTS

| | | | |
|---|---|---|---|
| CN | 102544888 | A | 7/2012 |
| CN | 202513365 | U | 10/2012 |
| JP | S62-121514 | U | 8/1987 |
| JP | S63-101476 | U | 7/1988 |
| JP | H9-273904 | A | 10/1997 |
| JP | 2003-331969 | A | 11/2003 |
| JP | 2012-59381 | A | 3/2012 |
| JP | 2012-59540 | A | 3/2012 |
| JP | 2012-238481 | A | 12/2012 |
| TW | M443292 | U1 | 12/2012 |
| TW | M443320 | U1 | 12/2012 |

* cited by examiner

FIG. 3A
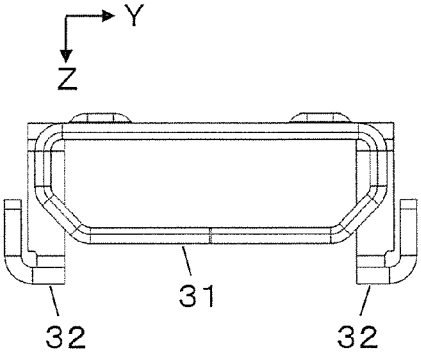
FIG. 3B
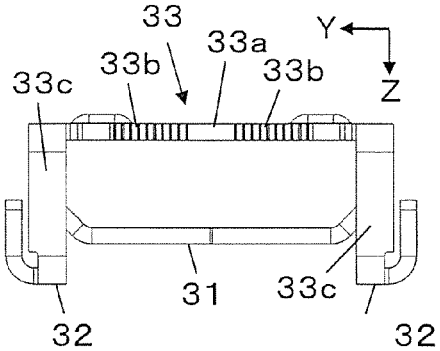
FIG. 3C
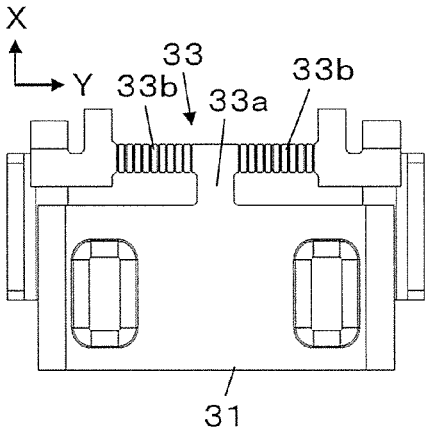
FIG. 3D
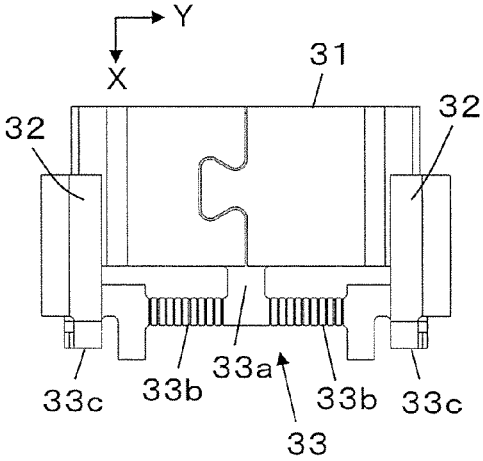
FIG. 3E
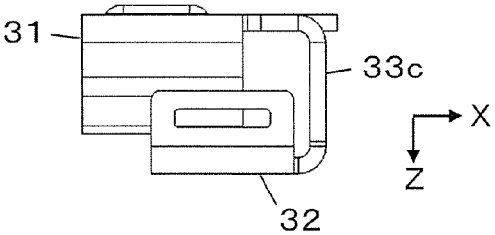
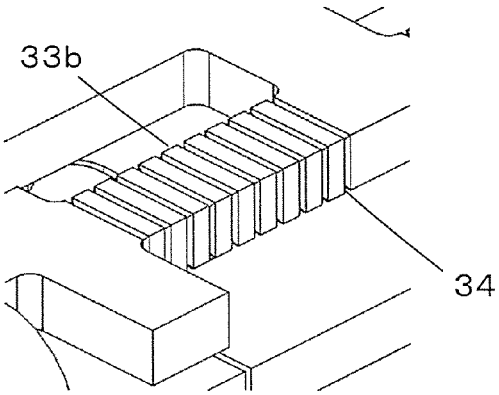
FIG. 4

WATERPROOF CONNECTOR WITH INTEGRATED SHELL AND CONTACT INTO HOUSING

TECHNICAL FIELD

The present invention relates to a waterproof connector, particularly to a waterproof connector in which a conductive member, such as a shell and a contact, and a housing made of an insulating resin are formed integrally with each other.

BACKGROUND ART

In recent years, electronic devices such as computers and mobile phones, have been widely used. These electronic devices are usually provided with a connector used to transmit signals by connection with an external device. As a connector of this type, connectors that are shielded against electromagnetic interference to prevent the electric signals being transmitted from being affected by electromagnetic waves from outside, are desirable.

In addition, there is a strong demand for waterproof function in various electronic devices and, accordingly, waterproof connectors having waterproof property have been under development.

Such a connector having both electromagnetic shielding property and waterproof property is disclosed, for example, in Patent Literature 1. This connector has a configuration, as shown in FIG. 34, in which a contact 2 to be used for conductive connection is disposed inside a tubular shell 1 made of metal, and the shell 1 and contact 2 are integrally molded in a housing 3 made of an insulating resin by insert molding and the like.

At a back end section of the shell 1, a ground terminal 4 exposed from the housing 3 is formed, and by connecting the ground terminal 4 to a grounding pattern and the like of a board on which the connector is mounted, the shell 1 has a ground potential, which provides shielding for the contact 2.

Owing to the integral molding of the shell 1 in the housing 3, the surface of the shell 1 adheres to the insulating resin making up the housing 3 and this prevents water from entering the side of the ground terminal 4, that is, the side of the board on which the connector is mounted from the outside of the connector through a boundary portion between the housing 3 and the shell 1.

CITATION LIST

Patent Literature

Patent Literature 1: JP 2012-59540 A

SUMMARY OF INVENTION

Technical Problems

In general, however, a metal material making up the shell 1 and a resin material making up the housing 3 are different in thermal expansion coefficient from each other and, therefore, when the connector is exposed to a high temperature environment during a soldering process, such as reflow mounting, in mounting the connector onto a circuit board of an electronic device for example, due to the difference in expansion amount between the shell 1 and the housing 3, the insulating resin adhering to the surface of the shell 1 may be separated from the surface of the shell 1. Once the insulating resin is separated, a gap is generated between the surface of the shell 1 and the housing 3 and water may disadvantageously enter the side of the ground terminal 4 through the gap even after the temperature falls to ambient temperature.

Aside from that, when a mating connector is fitted to a connector, the mating connector may be forcibly fitted in a direction oblique to the fitting axis, which is so-called "ill fitting," and a high stress may be applied to the portion between the housing 3 and the shell 1. In this case, again, insulating resin making up the housing 3 may be separated from a surface of the shell 1, which damages waterproof property of the connector.

Further, in a similar way, the waterproof property may also be damaged when the insulating resin of the housing 3 is separated from the surface of the contact 2.

The present invention is made to solve the above-mentioned problems with the prior art and an object thereof is to provide a waterproof connector capable of improving the waterproof property between the housing and the conductive members, such as shell and contact.

Solution to Problems

The waterproof connector according to the present invention is a waterproof connector adapted to be mounted on a board and to be fitted to a mating connector, the waterproof connector comprising: a housing made of an insulating resin; and at least one conductive member molded integrally with the housing, the conductive member having: a mating connector connecting section which is exposed from the housing and is connected to the mating connector; a board attachment section which is exposed from the housing and is attached to the board; and a housing holding section which connects between the mating connector connecting section and the board attachment section, and which is embedded in the housing, wherein a waterproof shaped section is formed at a surface of the housing holding section so as to block entry of water along an interface between the housing holding section and the housing.

The waterproof shaped section may comprise one or more waterproof grooves so formed as to separate the surface of the housing holding section into a part at a side of the mating connector connecting section and a part at a side of the board attachment section.

In that case, the waterproof grooves are preferably so formed as to surround the housing holding section and close themselves.

The waterproof grooves preferably have a groove depth of 0.01 mm or more.

The waterproof grooves preferably have a cross section which is triangular, arced, quadrangular or inverted triangular.

The waterproof grooves are preferably formed in each of surfaces of the housing holding section that are in contact with the housing.

The waterproof shaped section may have the waterproof grooves which are at least two in number and are formed in one surface of the housing holding section.

The waterproof grooves may be formed such that they have a triangular cross section, and a center line of each waterproof groove extending in the cross section from an opening to a bottom of the waterproof groove in a depth direction is oblique to the surface of the housing holding section.

In that case, the waterproof grooves preferably have a rounded groove bottom.

It is preferable that the waterproof grooves are formed in each of surfaces of the housing holding section that are in contact with the housing. In this regard, the waterproof grooves may be at least two in number, be formed in plural surfaces of the housing holding section, and may be identical to each other in direction where the center line is inclined with respect to a corresponding surface of the housing holding section. Alternatively, the waterproof grooves may be at least two in number, be formed in plural surfaces of the housing holding section, and include the waterproof grooves which are different from each other in direction where the center line is inclined with respect to a corresponding surface of the housing holding section.

The waterproof shaped section may have the waterproof grooves which are at least two in number and are formed in one surface of the housing holding section. In that case, the waterproof grooves formed in one surface of the housing holding section may be identical to each other in direction where the center line is inclined with respect to the surface of the housing holding section or, alternatively, the waterproof grooves formed in one surface of the housing holding section may include the waterproof grooves which are different from each other in direction where the center line is inclined with respect to the surface of the housing holding section.

The waterproof grooves may have an opening extending at a surface of the housing holding section in a direction perpendicular to a central axis of the housing holding section or extending at a surface of the housing holding section obliquely to a central axis of the housing holding section.

The waterproof shaped section may also comprise one or more waterproof protrusions so formed as to separate the surface of the housing holding section into a part at a side of the mating connector connecting section and a part at a side of the board attachment section.

In that case, the waterproof protrusions are preferably so formed as to surround the housing holding section and close themselves.

The waterproof protrusions preferably have a relative height of 0.01 mm or more.

The waterproof protrusions preferably have a cross section which is triangular, arced, quadrangular or inverted triangular.

The waterproof protrusions are preferably formed on each of surfaces of the housing holding section that are in contact with the housing.

The waterproof shaped section may have the waterproof protrusions which are at least two in number and are formed on one surface of the housing holding section.

In a possible configuration, the conductive member comprises a shell; the mating connector connecting section comprises a fitting section which fits to the mating connector; the housing holding section includes a shell narrowed portion which is formed narrower than the fitting section; and the waterproof shaped section is formed at a surface of the shell narrowed portion.

In another possible configuration, the conductive member comprises a shell; the mating connector connecting section comprises a fitting section which fits to the mating connector; the housing holding section has a hollow shape; and the waterproof shaped section is formed at each of outer and inner periphery surfaces of the housing holding section.

In still another possible configuration, the conductive member comprises a contact; and the mating connector connecting section comprises a contact section which comes into contact with a contact of the mating connector.

It is also possible that the housing holding section includes a contact narrowed portion which is formed narrower than the contact section and a board connecting section, and the waterproof shaped section is formed at a surface of the contact narrowed portion.

The inventive waterproof connector may also comprise a shell and one or more contacts as the conductive member. In such a configuration, the waterproof shaped section is formed at each of the shell and the one or more contacts.

Advantageous Effects of Invention

According to the present invention, since a waterproof shaped section to block the entry of water along the interface between the housing holding section and the housing is formed at the surface of the housing holding section of a conductive member to be embedded in the housing, the waterproof property between the housing and the conductive member can be improved.

BRIEF DESCRIPTION OF DRAWINGS

FIG. 1A-FIG. 1D show a waterproof connector according to Embodiment 1 of the present invention, wherein FIG. 1A is a perspective view with the view being taken diagonally from top and front; FIG. 1B is a perspective view with the view being taken diagonally from top and rear; FIG. 1C is a perspective view with the view being taken diagonally from bottom and front; and FIG. 1D is a perspective view with the view being taken diagonally from bottom and rear.

FIG. 2A-FIG. 2D show a shell used in the waterproof connector of Embodiment 1, wherein FIG. 2A is a perspective view with the view being taken diagonally from top and front; FIG. 2B is a perspective view with the view being taken diagonally from top and rear; FIG. 2C is a perspective view with the view being taken diagonally from bottom and front; and FIG. 2D is a perspective view with the view being taken diagonally from bottom and rear.

FIG. 3A-FIG. 3E show the shell used in the waterproof connector of Embodiment 1, wherein FIG. 3A is a front view; FIG. 3B is a back view; FIG. 3C is a plan view; FIG. 3D is a bottom view; and FIG. 3E is a side view.

FIG. 4 is a perspective view showing a waterproof shaped section of the shell used in the waterproof connector of Embodiment 1.

FIG. 14A and FIG. 14B show the waterproof connector of Embodiment 1, which is aligned to a board, wherein FIG. 14A is a perspective view with the view being taken diagonally from top and front; and FIG. 14B is a perspective view with the view being taken diagonally from bottom and rear.

FIG. 16A and FIG. 16B show the waterproof connector of Embodiment 1, which is attached to the enclosure, wherein FIG. 16A is a perspective view with the view being taken diagonally from front; and FIG. 16B is a perspective view with the view being taken diagonally from rear.

FIG. 24A-FIG. 24D contain partial cross-sectional views showing various waterproof grooves used in a waterproof connector according to Embodiment 4 of the invention, wherein FIG. 24A shows a triangular shaped groove; FIG. 24B shows an arched shaped groove; FIG. 24C shows a quadrangular shaped groove; and FIG. 24D shows an inverted triangular or inversely tapered shaped groove.

FIG. 25A-FIG. 25D contain partial cross-sectional views showing various waterproof protrusions used in a waterproof connector according to a modification of Embodiment 4 of the invention, wherein FIG. 25A shows a triangular shaped protrusion; FIG. 25B shows an arched shaped protrusion; FIG. 25C shows a quadrangular shaped protrusion; and FIG. 24D shows an inverted triangular or inversely tapered shaped protrusion.

DESCRIPTION OF EMBODIMENTS

Figure 1A:
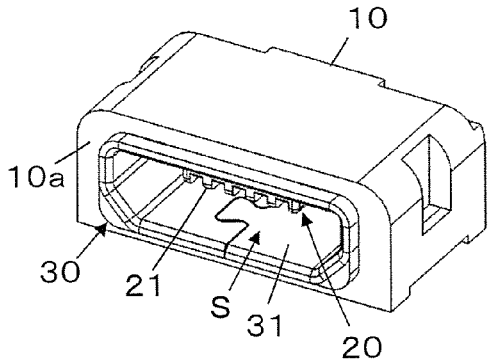
Figure 1B:
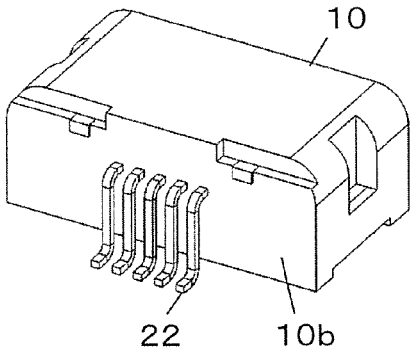
Figure 1C:
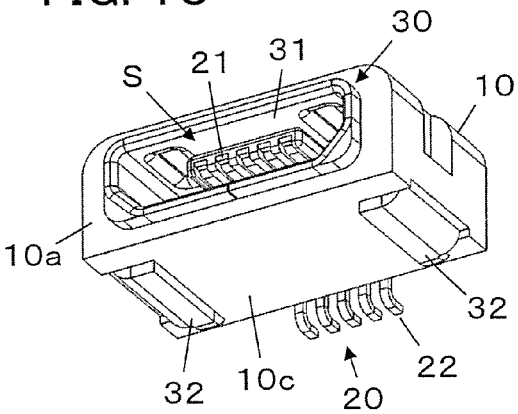
Figure 1D:
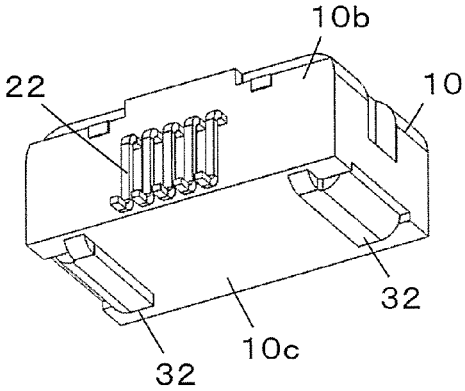
Figure 2A:
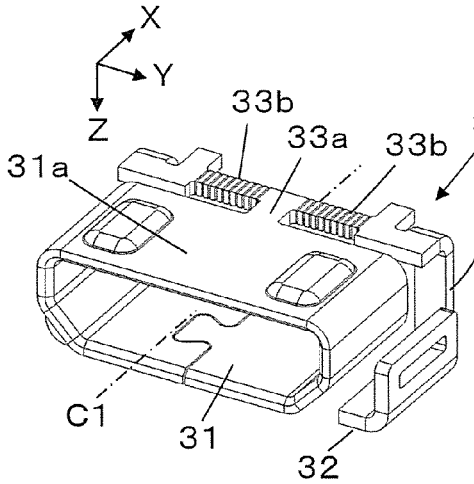
Figure 2B:
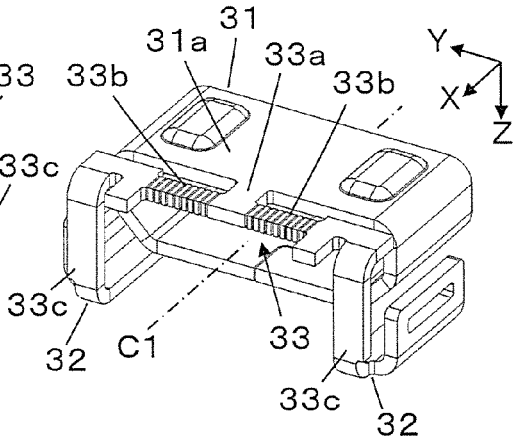
Figure 2C:
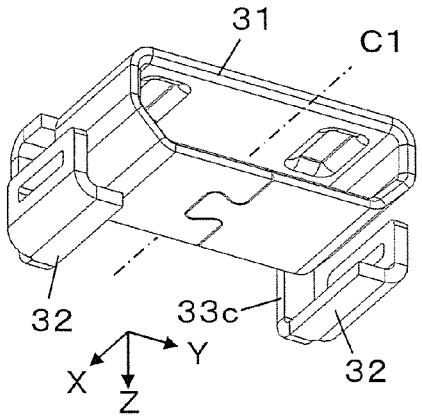
Figure 2D:
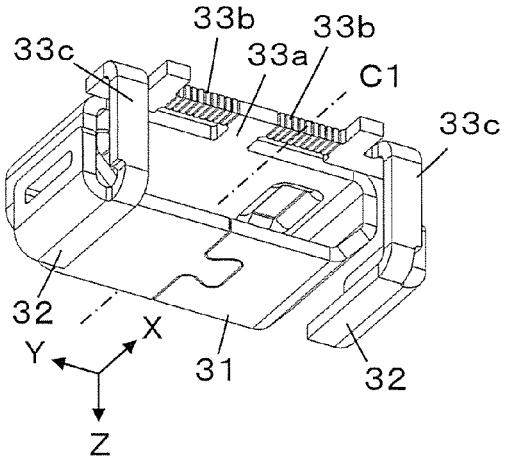

Embodiments of the present invention will be described below based on the appended drawings.

Embodiment 1

FIGS. 1(A) to 1(D) show a configuration of a waterproof connector according to Embodiment 1 of the present invention. The waterproof connector has a housing 10 having an approximately cuboid outer shape, plural contacts 20 fixed to the housing 10, and a shell 30 which is fixed to the housing 10, and is to shield the plural contacts 20. The housing 10 is formed of an insulating resin. The contacts 20 and the shell 30 are formed of a conductive metal material.

The shell 30 has a hollow fitting section 31 which has an opening at a side of a front surface 10*a* of the housing 10, and a space S to be fitted to a mating connector is formed inside the fitting section 31. A contact section 21 located at a front end of each of the contacts 20 is disposed in the space S of the fitting section 31 of the shell 30. On the other hand, a board connecting section 22 located at a back end of each of the contacts 20 is exposed from a back surface 10*b* of the housing 10 to outside the housing 10.

Also, the shell 30 has a pair of board attachment sections 32. The board attachment sections 32 are exposed from a lower surface 10*c* of the housing 10 to outside the housing 10.

As shown in FIGS. 2(A) to 2(D) and FIGS. 3(A) to 3(E), the fitting section 31 of the shell 30 has a central axis C1, and has a tubular shape with an elongated flat cross-sectional shape, in a direction perpendicular to the central axis C1. Hereinafter, for the sake of convenience, a direction extending from front to rear of the fitting section 31, in parallel with the central axis C1 is referenced as X direction, a plane in which an upper surface 31*a* of the flat fitting section 31 extends, is referenced as XY-plane, and a direction which is perpendicular to the upper surface 31*a* of the fitting section 31 and extends downwardly is referenced as Z direction.

The shell 30 has a housing holding section 33 which connects the fitting section 31 and the pair of board attachment sections 32. The housing holding section 33 includes: a backward projecting section 33*a* which projects in the X direction from a center of an upper rear end of the fitting section 31 along the central axis C1 of the fitting section 31; a pair of arm sections 33*b* which extend from the rear end of the backward projecting section 33*a* in both directions parallel with the upper surface 31*a* of the flat fitting section 31 and perpendicular to the central axis C1, that is, extend in Y direction and −Y direction respectively; and a pair of leg sections 33*c* which extend downwardly from respective distal ends of the arm sections 33*b*, that is, extend in Z direction. And the board attachment sections 32 are connected at bottom ends of the pair of leg sections 33*c*, respectively. The pair of board attachment sections 32 are configured to extend in a direction from the rear to the front of the fitting section 31, that is, extend in −X direction in the XY-plane.

The backward projecting section 33*a*, the pair of arm sections 33*b*, and the pair of leg sections 33*c* of the housing holding section 33 each form a shell narrowed portion narrower than the fitting section 31. The housing holding section 33 having such a shell narrowed portion is embedded in the housing 10, when the shell 30 is molded in the housing 10.

Further, as shown in FIG. 4, in an outer periphery of the pair of arm sections 33*b*, plural shell grooves 34 parallel to each other are formed as a waterproof groove. Each of the shell grooves 34 is formed so as to surround and enclose the periphery of the arm sections 33*b*. By each shell groove 34, the surface of the housing holding section 33 is separated into a side of the fitting section 31 and a side of the board attachment section 32. The shell grooves 34 form a shell waterproof shaped section for blocking the entry of water along the interface between the housing holding section 33 and the housing 10, when the shell 30 is molded in the housing 10.

Figure 5:
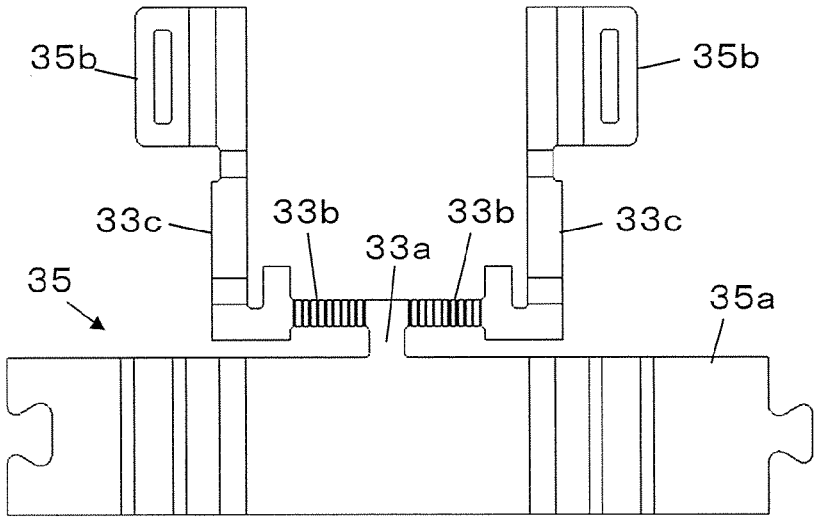
FIG. 5 is a development view of the shell used in the waterproof connector of Embodiment 1.

The shell 30 having such configuration may be made by cutting a conductive metal plate 35 into a shape as shown in FIG. 5, and performing a folding process with a press and the like. A belt shaped section 35*a*, which is shaped in a flat tubular shape, constitutes the fitting section 31. The backward projecting section 33*a* projects from an outer edge section in the center of the belt shaped section 35*a*. The pair of arm sections 33*b* are connected to the distal ends of the backward projecting section 33*a*. The pair of leg sections 33*c* are connected to the distal ends of the pair of arm sections 33*b*. The board attachment sections 32 are formed from flat plate sections 35*b* connected to the distal ends of the pair of leg sections 33*c*, respectively.

As apparently from a development view of FIG. 5, on a route from the belt shaped section 35*a* constituting the fitting section 31, to the pair of flat plate sections 35*b* constituting the board attachment sections 32, the arm sections 33*b* having the shell grooves 34 respectively, exist.

Figure 6:
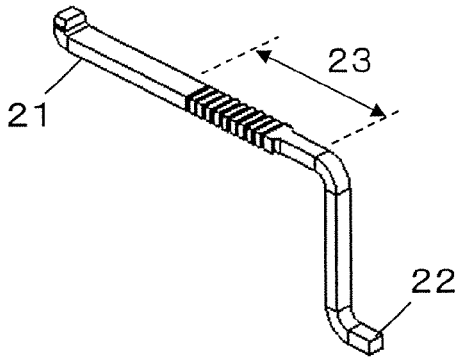
FIG. 6 is a perspective view showing a contact used in the waterproof connector of Embodiment 1.
Figure 7:
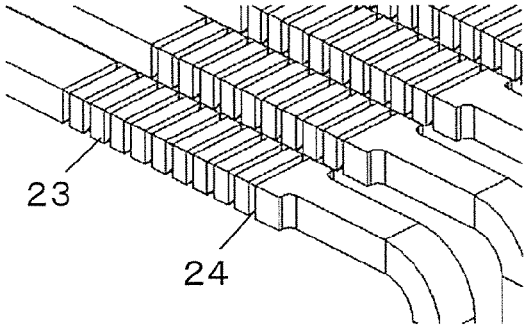
FIG. 7 is a perspective view showing a housing holding section of the contact used in the waterproof connector of Embodiment 1.

FIG. 6 shows a configuration of the contact 20. The contact 20 is formed of a bar member or a planar member, and a housing holding section 23 is formed between the contact section 21 and the board connecting section 22. The housing holding section 23, when molded in the housing 10 together with the shell 30, is embedded in the housing 10, so as to fix the contact 20 to the housing 10. As shown in FIG. 7, plural contact grooves 24 parallel to each other are formed at an outer periphery surface of the housing holding section 23, as a waterproof groove. Each of the contact grooves 24 is formed so as to surround and enclose the periphery of the housing holding section 23. By the contact grooves 24, the surface of the contact 20 is separated into a side of the contact section 21, and a side of the board connecting section 22. These contact grooves 24, when the contact 20 is molded in the housing 10, form a contact waterproof shaped section for blocking the entry of water along the interface between the housing holding section 23 and the housing 10.

Figure 8:
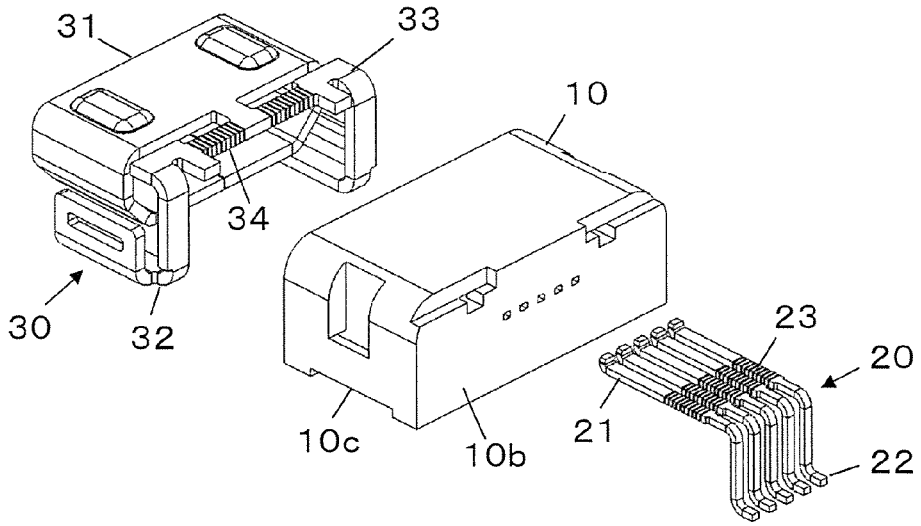
FIG. 8 is an exploded perspective view of the waterproof connector according to Embodiment 1.

FIG. 8 shows an exploded view of the waterproof connector. The housing 10 is molded integrally with the shell 30 and the plural contacts 20, such that an inside surface of the fitting section 31 of the shell 30 is exposed to a front end side of the housing 10, the housing holding section 33 in which the shell groove 34 is formed is embedded in the housing 10, the board attachment sections 32 are exposed from the lower surface 10*c* of the housing 10, the contact sections 21 of the plural contacts 20 are exposed inside the fitting section 31 of the shell 30, the housing holding sections 23 are embedded in the housing 10, and the board connecting sections 22 are exposed from the back surface 10*b* of the housing 10.

At this time, the plural contacts 20 and the shell 30 are set in a not shown die, such that the contact section 21 of the contact 20 is positioned in the fitting section 31 of the shell 30. The die is closed and a melted insulating resin material is injected into the die. Then the die is cooled, thereby the housing 10, the plural contacts 20, and the shell 30 are molded integrally, to allow a waterproof connector as shown in FIGS. 1(A) to 1(D) to be manufactured.

Figure 9:
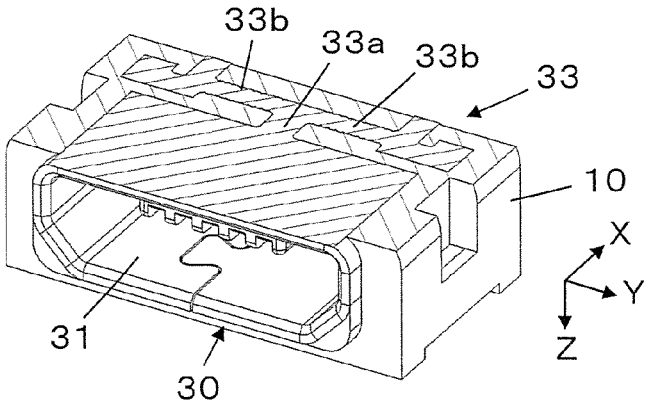
FIG. 9 is a perspective view showing the waterproof connector according to Embodiment 1, with the view being taken by cutting at a height of the shell waterproof shaped section.
Figure 10:
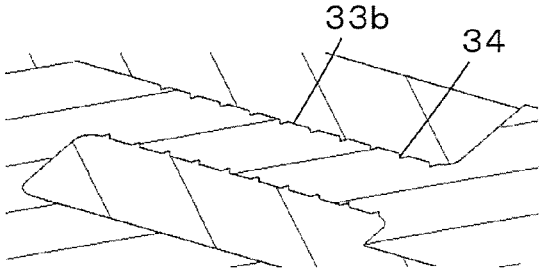
FIG. 10 is a main part enlarged view of FIG. 9.

FIG. 9 shows the waterproof connector according to Embodiment 1, with the view being taken by cutting along the XY-plane at a height of the pair of arm sections 33*b* of the shell 30. The housing holding section 33 of the shell 30 is embedded in the housing 10, and the pair of arm sections 33*b* are connected from the fitting section 31 through the backward projecting section 33*a*. Also, the inside surface of the fitting section 31 is exposed without being covered by the housing 10. Since the plural shell grooves 34 are formed in the arm sections 33*b* so as to surround and enclose the periphery of the arm sections 33*b*, the cross-sectional shape of the shell groove 34 appears on both side edges of the cut section of the arm sections 33*b*, as shown in FIG. 10.

Figure 11:
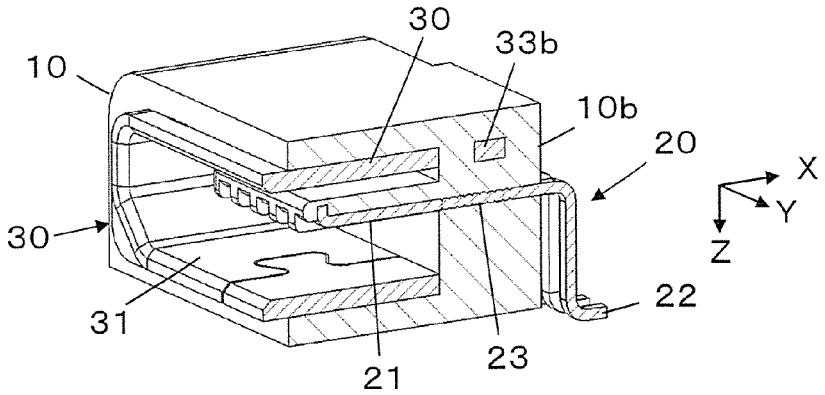
FIG. 11 is a perspective view showing the waterproof connector according to Embodiment 1, with the view being taken by cutting at a location of the contact.
Figure 12:
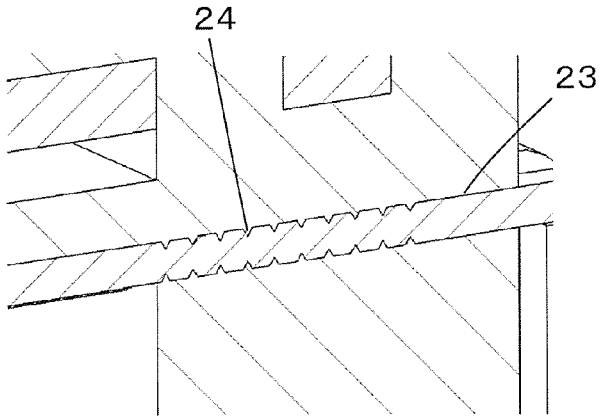
FIG. 12 is a main part enlarged view of FIG. 11.

Also, FIG. 11 shows the waterproof connector, with the view being taken by cutting along the XZ-plane at a location of the contact 20. The contact section 21 of the contact 20 is exposed in the fitting section 31 of the shell 30, and the board connecting section 22 is exposed projecting backwardly from the back surface 10*b* of the housing 10, and the housing holding section 23 is embedded in the housing 10. In addition, above the housing holding section 23 of the contact 20, a cut section of the arm section 33*b* of the shell 30 is shown. Since, in the housing holding section 23 of the contact 20, the plural contact grooves 24 are formed so as to surround and enclose the periphery of the housing holding section 23, the cross-sectional shape of the shell groove 24 appears on both side edges of the cut section of the housing holding section 23, as shown in FIG. 12.

Integral molding of the housing 10, the shell 30, and the contact 20 allows the insulating resin constituting the housing 10 to be made in close contact with surfaces of the housing holding section 33 of the shell 30 and the housing holding section 23 of the contact 20 that are embedded in the housing 10.

As described above, in the housing holding section 33 of the shell 30 to be embedded in the housing 10, the plural shell grooves 34 are formed so as to surround and enclose the periphery of the arm sections 33*b* existing on the route from the fitting section 31 to the board attachment sections 32. Therefore, even if the insulating resin of the housing 10, which was made in close contact with the surface of the housing holding section 33 of the shell 30 is separated off from the housing holding section 33, and water penetrates from the fitting section 31, along the interface between the housing holding section 33 and the housing 10, due to, for example, the difference in the thermal expansion coefficients of the insulating resin material constituting the housing 10 and the metal material constituting the shell 30, or due to so-called ill fitting, that is, forced fitting action in a direction oblique to the fitting axis, during fitting operation to a mating connector, the water which penetrated is blocked by the plural shell grooves 34, once the water reaches the arm sections 33*b* of the housing holding section 33, so as to prevent the water from reaching the board attachment section 32 exposed from the lower surface 10*c* of the housing 10.

In particular, the arm section 33*b* in which the plural shell grooves 34 are formed, constitutes a shell narrowed portion which is narrower than the fitting section 31 so as to restrict an amount of water to be entered, and thereby with these shell grooves 34 the waterproof capability can be exerted effectively.

Likewise, since in the housing holding section 23 of the contact 20, which is to be embedded in the housing 10, the plural contact grooves 24 are formed so as to surround and enclose the periphery of the housing holding section 23, even if the insulating resin of the housing 10, which is made in contact with the surface of the housing holding section 23 of the contact 20 is separated off from the housing holding section 23, and water penetrates from the contact section 21 which is exposed in the fitting section 31 of the shell 30 along the interface between the housing holding section 23 and the housing 10, due to the difference in the heat expansion coefficients or so-called ill fitting and the like, the water which penetrated can be blocked by the plural contact grooves 24, to prevent the water from reaching the board connecting section 22 which is exposed from the back surface 10*b* of the housing 10.

In this way, the waterproof property between the housing 10 and the shell 30, and the contact 20 is improved to prevent the entry of water into a device, that is, on the board side on which the waterproof connector is mounted.

Figure 13:
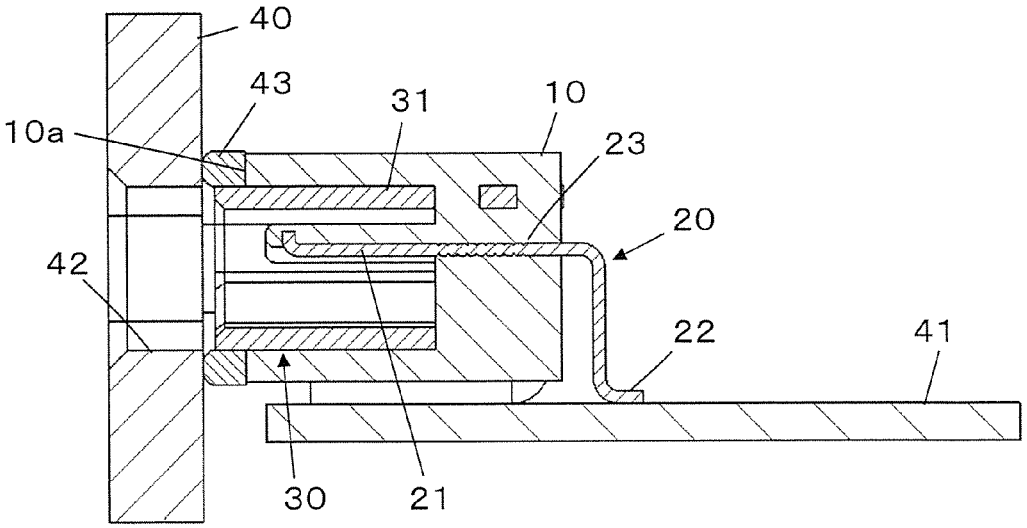
FIG. 13 is a side cross-sectional view showing the waterproof connector of Embodiment 1, which is attached to an enclosure.

The waterproof connector according to Embodiment 1 is used for example, as shown in FIG. 13, by mounting it on a board 41 fixed in an enclosure 40 of an electronic device, such as a mobile phone. In the enclosure 40, an opening section 42 corresponding to the fitting section 31 of the shell 30 is formed, and a space between an inside surface of the enclosure 40 on a periphery of the opening section 42 and the front surface 10*a* of the housing 10 is sealed by a gasket 43.

With such a configuration, moisture existing outside the enclosure 40 is blocked by the plural shell grooves 34 of the housing holding section 33 of the shell 30 and the plural contact grooves 24 of the housing holding section 23 of the contact 20, both housing holding sections being embedded in the housing 10, so as not to enter into the enclosure 40 from the fitting section 31 of the shell 30, and also blocked by the gasket 43, so as not to enter into the enclosure 40 from a space between the enclosure 40 and the housing 10, thus enabling the waterproof capability to be exerted.

Figure 14A:
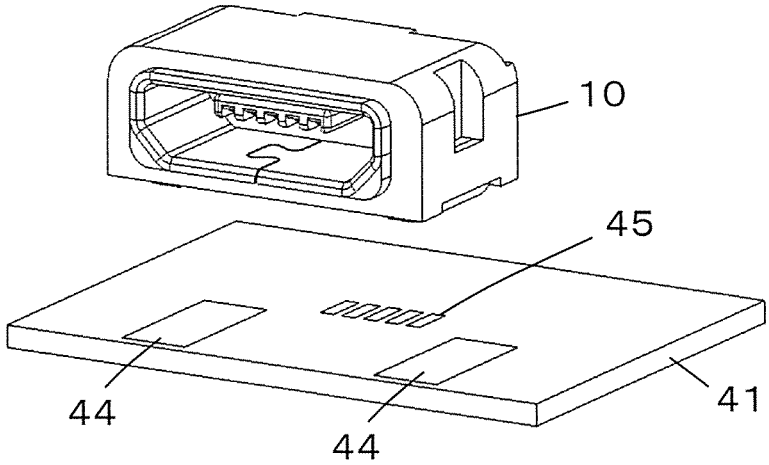
Figure 14B:
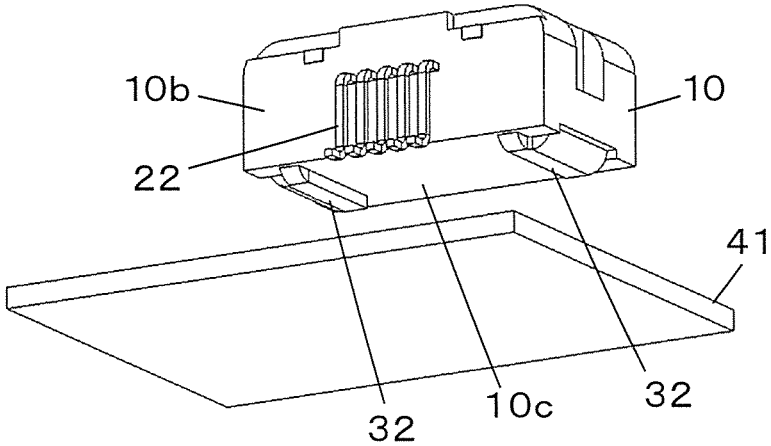
Figure 15:
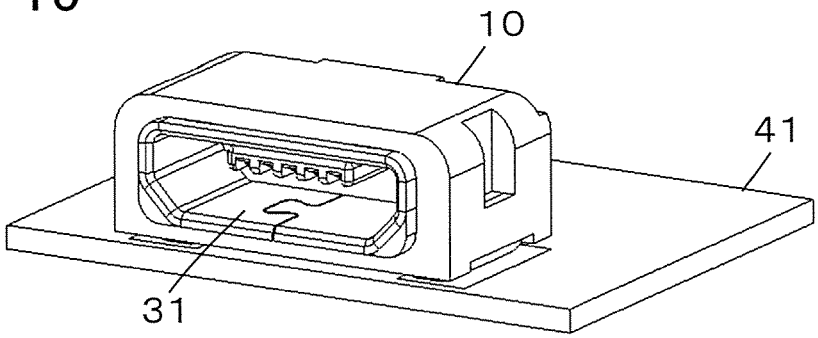
FIG. 15 is a perspective view showing the waterproof connector of Embodiment 1, which is mounted on the board.
Figure 16A:
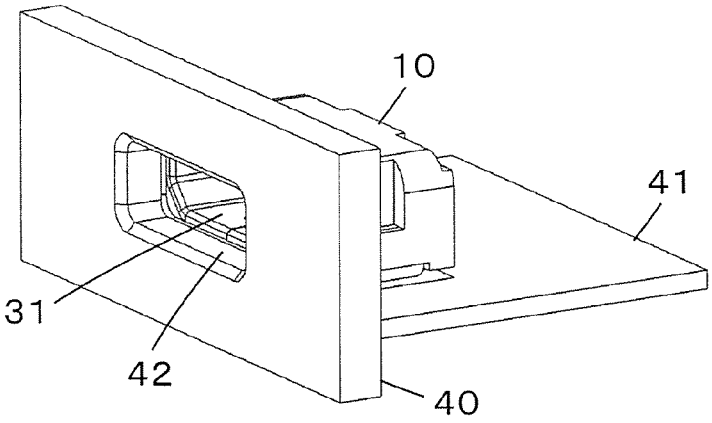
Figure 16B:
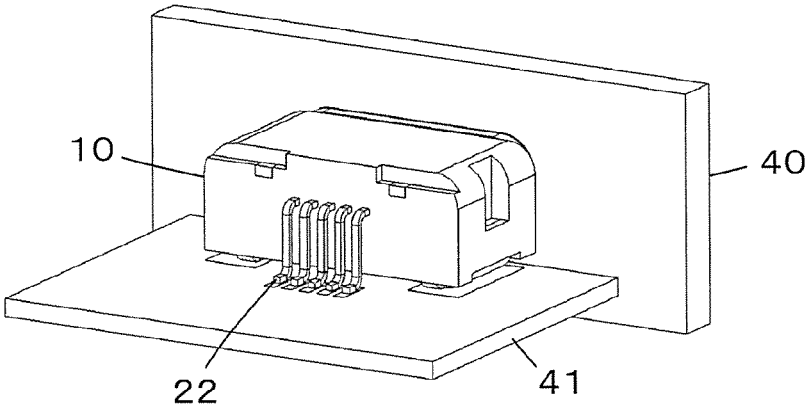

In order to attach the waterproof connector to the enclosure 40, firstly, as shown in FIGS. 14(A) and 14(B), the board attachment sections 32 of the shell 30, which are exposed from the lower surface 10*c* of the housing 10 are aligned to a grounding pattern 44 on the board 41, and also the board connecting sections 22 of the plural contacts 20, which are exposed from the back surface 10*b* of the housing 10 are aligned to a wiring pattern 45 on the board 41. Then, the board attachment sections 32 of the shell 30 are soldered to the grounding pattern 44 of the board 41, and also the board connecting sections 22 of the plural contacts 20 are soldered to the wiring pattern 45 of the board 41, so that the waterproof connector is fixed onto the board 41, as shown in FIG. 15. Then the board 41 is fixed in the enclosure 40, as shown in FIGS. 16(A) and 16(B), so that the inside surface of the fitting section 31 of the shell 30 is exposed through the opening section 42 of the board 41, and the gasket 43 is pressed into between the inside surface of the enclosure 40 and the front surface 10*a* of the housing 10.

In order to block the entry of water along the interface between the housing holding section 33 of the shell 30 and the housing 10, and the entry of water along the interface between the housing holding section 23 of the contact 20 and the housing 10, the shell groove 34 formed in the arm section 33*b* of the shell 30, and the contact groove 24 formed in the housing holding section 23 of the contact 20 preferably have a relative height, or a depth, of 0.01 mm or more, for example.

In addition, although instead of forming the plural shell grooves 34 in the arm section 33*b* of the shell 30, one shell groove 34 may be formed to suppress the entry of water along the interface with the housing 10, forming of the plural shell grooves 34 can exert a higher waterproof capability. Likewise, although instead of forming the plural contact grooves 24 in the housing holding section 23 of the contact 20, one contact groove 24 may be formed to suppress the entry of water along the interface with the housing 10, forming of the plural contact grooves 24 can exert more excellent waterproof effect.

While, the shell 30 has the pair of board attachment sections 32 exposed from the lower surface 10*c* of the housing 10, the shell 30 can have only one board attachment section 32, or three or more board attachment sections 32. In the case of one board attachment section 32, one arm section 33*b* may be formed on a route from the fitting section 31 to the board attachment section 32, and on the surface of this arm section 33*b*, the shell groove 34 may be formed. In the case where the shell 30 has three or more board attachment sections 32, the shell grooves 34 may be disposed such that any of them exists on a route from the fitting section 31 to each of the board attachment sections 32. The number of arm sections 33*b* in which the shell groove 34 is formed, may be the same as or lower than the number of board attachment sections 32.

While the fitting section 31 of the shell 30 has a flat tubular shape so as to cover entire periphery of the contact sections 21 of the plural contacts 20, the present invention is not limited to this, and depending on the situation of using the waterproof connector, the same shielding effect can be exerted by having a shape to cover only a part of the contact sections 21 of the plural contacts 20. Further, in the case where the shell is used for a purpose of attaching the waterproof connector to the board 41 through the board attachment sections 32 without requiring such shielding effect, the shell may not cover the contact sections 21 of the plural contacts 20.

Embodiment 2

While in the shell 30 used in the above described Embodiment 1, the plural shell grooves 34 are formed in the arm section 33*b* of the housing holding section 33, the present invention is not limited to the arm section 33*b*, and the plural shell grooves 34 may be formed in a narrowed portion of the housing holding section 33, which is to be embedded in the housing 10 and disposed on a route from the fitting section 31 to the board attachment sections 32.

Figure 17:
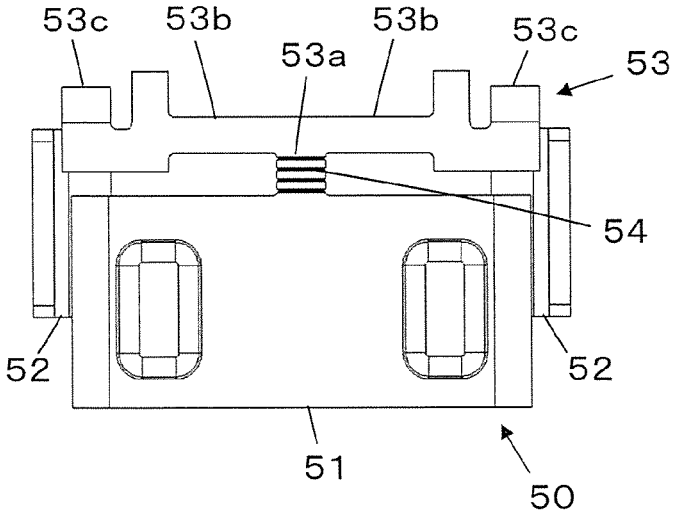
FIG. 17 is a plan view showing a shell used in a waterproof connector according to Embodiment 2.

For example, as in a shell 50 shown in FIG. 17, plural shell grooves 54 may be formed in a surface of a backward projecting section 53*a* which projects backwardly from a back end of a fitting section 51. The shell 50 has the same configuration as that of the shell 30 used in Embodiment 1, except that the plural shell grooves 54 are formed in the backward projecting section 53*a*. That is: a housing holding section 53 is disposed between the fitting section 51 and a pair of board attachment sections 52; the housing holding section 53 includes the backward projecting section 53*a*, a pair of arm sections 53*b* connected to the back end of the backward projecting section 53*a*, and a pair of leg sections 53*c* connected to a distal end of both of the arm sections 53*b*; and a corresponding board attachment section 52 is connected to a distal end of each of the leg sections 53*c*.

In order to reach both of the board attachment sections 52 from the fitting section 51 along the surface of the shell 50, it is necessary to go through the backward projecting section 53*a*. By forming the plural shell grooves 54 in the outer periphery surface of the backward projecting section 53*a*, the entry of water along the interface between the housing holding section 53 and the housing 10 can be blocked.

Likewise, instead of forming in the backward projecting section 53*a*, the plural shell grooves 54 may be formed in the surface of each of the pair of leg sections 53*c*, to enable the same waterproof effect to be exerted.

Embodiment 3

Although in the shells 30 and 50 used in Embodiments 1 and 2, the plural shell grooves 34 and 54 are formed in the leg sections 33*c* and the backward projecting section 53*a*, that are narrowed portions, respectively, they are not necessarily formed in a narrowed portion.

Figure 18:
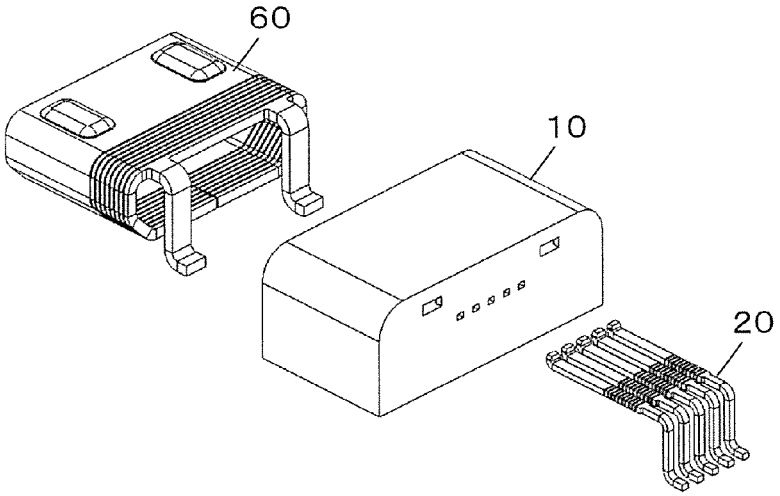
FIG. 18 is an exploded perspective view of a waterproof connector according to Embodiment 3.

FIG. 18 shows an exploded view of the waterproof connector according to Embodiment 3. This waterproof connector uses a shell 60 with no narrowed portions, instead of the shell 30 in the waterproof connector of Embodiment 1.

Figure 19:
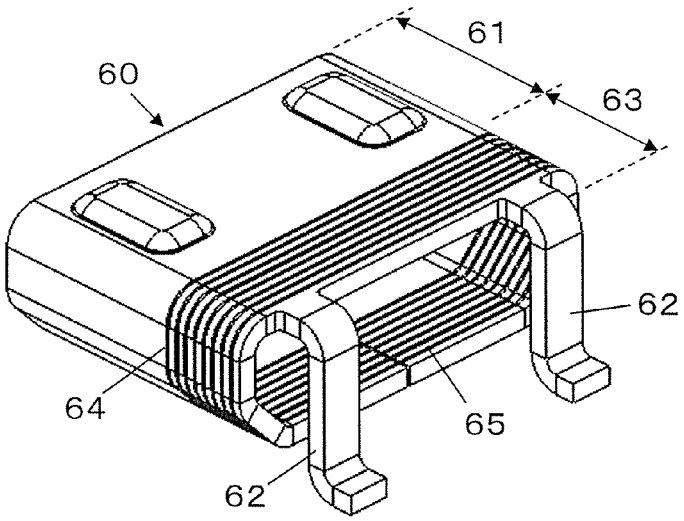
FIG. 19 is a perspective view showing a shell used in the waterproof connector according to Embodiment 3.

The shell 60, as shown in FIG. 19, has a fitting section 61 of a hollow flat tubular shape, and a housing holding section 63 of a hollow flat tubular shape, which is coupled to a back end side of the fitting section 61 and provided with a pair of board attachment sections 62 formed projectingly from the back end of the housing holding section 63. That is, one tube-shaped body is halved into a front end side portion and a back end side portion, with the front end side portion being used as the fitting section 61, and the back end side portion as the housing holding section 63.

Of the fitting section 61 covering the contact sections 21 disposed at the front end of the plural contacts 20, the inside surface portion is exposed from the housing 10. In the housing holding section 63, the inside surface portion and the outside surface portion are all embedded in the housing 10.

Plural shell grooves 64 parallel to each other are formed in an outer periphery surface of the housing holding section 63, and also plural shell grooves 65 parallel to each other are formed in an inner periphery surface of the housing holding section 63. Each of the shell grooves 64 is formed so as to surround and enclose the outer periphery of the housing holding section 63, and each of the shell grooves 65 is formed so as to surround and enclose the inner periphery of the housing holding section 63.

In order to reach both of the board attachment sections 62, from the fitting section 61, along the surface of the shell 60, it is necessary to override the shell groove 64 or the shell groove 65. Therefore, with these shell grooves 64 and 65, the entry of water along the interface between the housing holding section 63 and the housing 10 can be blocked.

Figure 20:
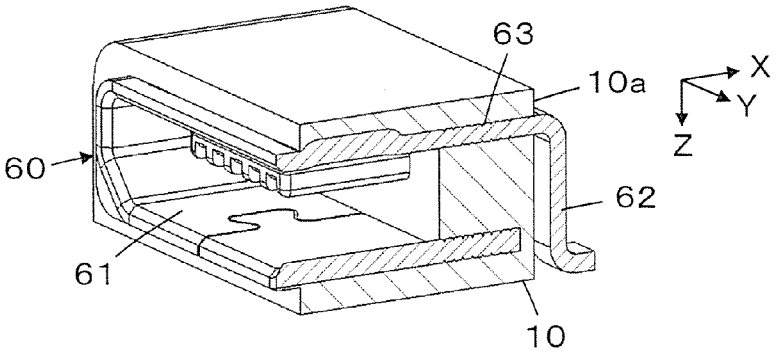
FIG. 20 is a perspective view showing the waterproof connector according to Embodiment 3, with the view being taken by cutting at a location of board attachment section of the shell.
Figure 21:
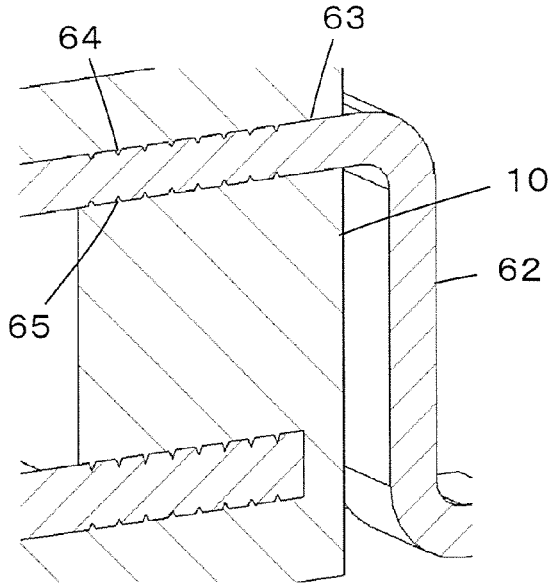
FIG. 21 is a main part enlarged view of FIG. 20.

FIG. 20 shows the waterproof connector according to Embodiment 3, with the view being taken by cutting at a location of the board attachment sections 62 of the shell 60, along XZ-plane. The inside surface of the fitting section 61 of the shell 60 is exposed without being covered by the housing 10, the housing holding section 63 is embedded in the housing 10, and the board attachment sections 62 connected to the back end of the housing holding section 63 are projected and exposed from the back surface 10*b* of the housing 10. The shell grooves 64 and 65 are formed in the outer periphery surface and the inner periphery surface of the housing holding section 63, respectively. Therefore, as shown in FIG. 21, the cross-sectional shape of the shell grooves 64 and 65 appears on both side edges of a cut section of the housing holding section 63.

Figure 22:
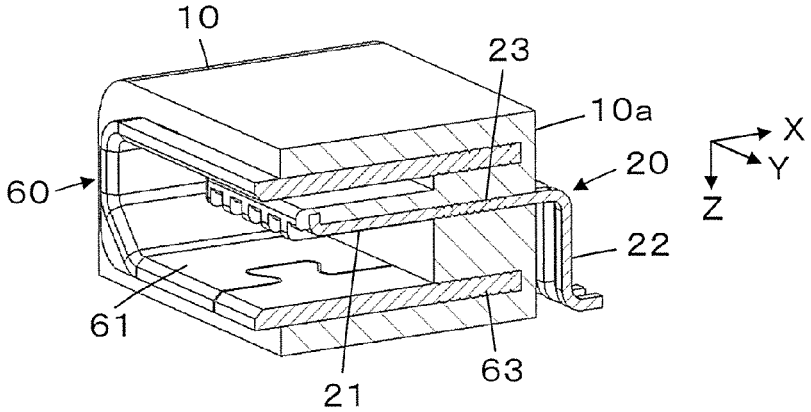
FIG. 22 is a perspective view showing the waterproof connector according to Embodiment 3, with the view being taken by cutting at a location of the contact.
Figure 23:
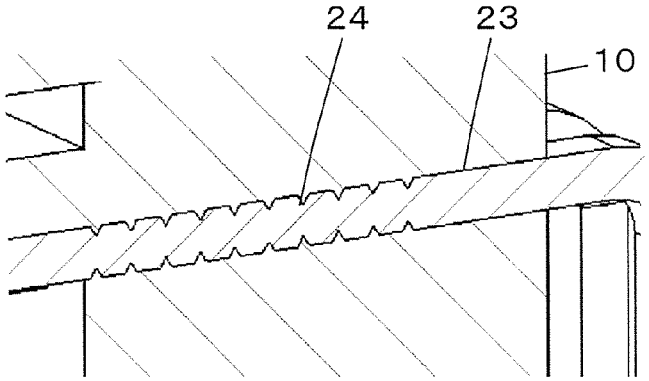
FIG. 23 is a main part enlarged view of FIG. 22.

In addition, FIG. 22 shows the waterproof connector, with the view being taken by cutting at a location of the contact 20, along the XZ-plane. The contact section 21 of the contact 20 is exposed in the fitting section 61 of the shell 60, the board connecting section 22 is exposed from the back surface 10*b* of the housing 10, projecting backwardly, and the housing holding section 23 is embedded in the housing 10. The plural contact grooves 24 are formed in the housing holding section 23 of the contact 20 so as to surround and enclose the periphery of the housing holding section 23. Therefore, a cross-sectional shape of the contact grooves 24 appears on both side edges of the cut section of the housing holding section 23, as shown in FIG. 23.

In this way, even if the shell 60 having the hollow housing holding section 63 is used, an excellent waterproof effect can be obtained between the housing 10 and the shell 60, and the contact 20.

Embodiment 4

Figure 24A:
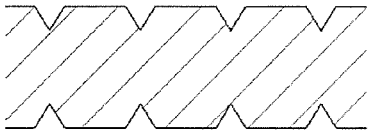
Figure 24B:
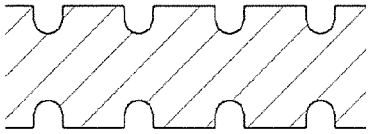
Figure 24C:
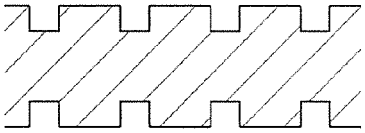
Figure 24D:
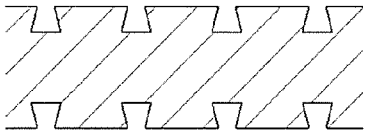

The cross-sectional shape of the shell grooves 34, 54, 64, and 65 used in the above described Embodiments 1 to 3 is not limited to a particular shape. For example, with a triangular shape as shown in FIG. 24(A), an arced shape as shown in FIG. 24(B), a quadrangular shape as shown in FIG. 24(C) or an inverted triangular shape or inversely tapered shape as shown in FIG. 24(D), an excellent waterproof capability can be exerted.

Also, the contact grooves 24 to be formed in the housing holding section 23 of the contact 20 can be formed so as to have various cross-sectional shapes as shown in FIGS. 24(A) to 24(D).

In addition, as a shell waterproof shaped section to be formed at the surface of the housing holding section of the shell, instead of a shell groove, a shell protrusion which projects form the surface of the housing holding section may be used. By separating the surface of the housing holding section, with the shell protrusion, into a fitting section side and a board attachment section side, the entry of water along the interface between the housing holding section and the housing can be blocked, as with the shell groove.

Figure 25A:
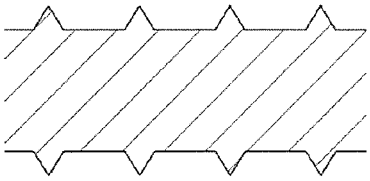
Figure 25B:
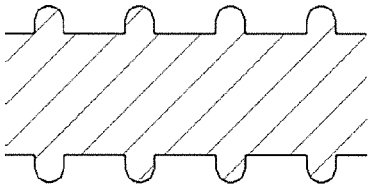
Figure 25C:
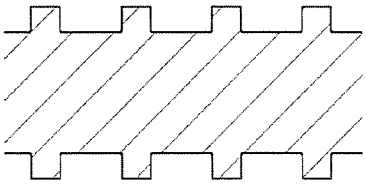
Figure 25D:
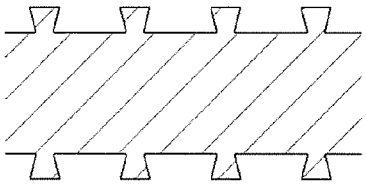

As the shell protrusion, those having a cross-section of a triangular shape as shown in FIG. 25(A), an arced shape as shown in FIG. 25(B), a quadrangular shape as shown in FIG. 25(C), and an inverted triangular shape or inversely tapered shape as shown in FIG. 25(D) may be used.

Also, as the contact waterproof shaped section to be formed at the surface of the housing holding section of the contact, instead of a contact groove, a contact protrusion projecting from the surface of the housing holding section, and having any of various cross-sectional shapes as shown in FIGS. 25(A) to 25(D) may be used to block the entry of water along the interface between the housing holding section and the housing.

Although one shell protrusion formed on the housing holding section of the shell, can block the entry of water along the interface with the housing, forming of plural shell protrusions can exert a higher waterproof capability. Likewise, although one contact protrusion formed on the housing holding section of the contact can suppress the entry of water along the interface with the housing, forming of plural contact protrusions can provide a more excellent waterproof effect.

In order to block the entry of water along the interface with housing, it is desirable for the shell protrusion and the contact protrusion to have a relative height, or a height, of 0.01 mm or more, for example.

The grooves shown in FIGS. 24(A) to 24(D), and protrusions shown in FIGS. 25(A) to 25(D), may be formed using mechanical processes, such as laser machining, press working and grinding, or chemical processes, such as etching.

Although in the above described Embodiments 1 to 3, the shell grooves 34, 54, 64, and 65 are formed so as to surround and enclose the periphery of the housing holding sections 33, 53, and 63, the shell groove or the shell protrusion is not necessarily to enclose the entire periphery of the housing holding section. A waterproof effect can be obtained by forming the shell groove or the shell protrusion in only one portion along the periphery of the housing holding section. However, a more excellent waterproof effect can be exerted by surrounding and enclosing the periphery of the housing holding section.

Embodiment 5

Figure 26:
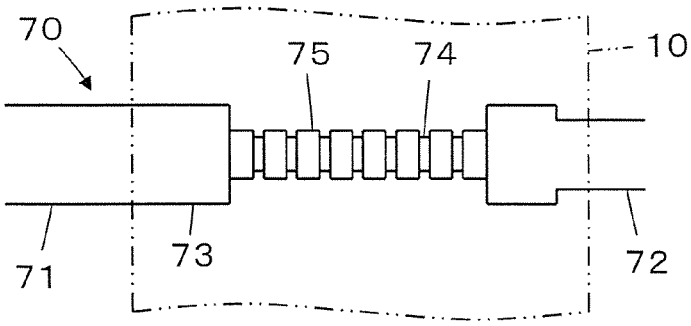
FIG. 26 is a partial plan view showing a waterproof shaped section of a contact used in a waterproof connector according to Embodiment 5.

FIG. 26 shows a main part of a contact 70 used in a waterproof connector according to Embodiment 5. Similar to the contact 20 shown in FIG. 6, the contact 70 has a housing holding section 73 formed between a contact section 71 and a board connecting section 72, and this housing holding section 73 is to be embedded in the housing 10. In this regard, however, a contact narrowed portion 75 narrower than the contact section 71 and the board connecting section 72 is formed in the housing holding section 73, and plural contact grooves 74 parallel to each other are formed in an outer periphery surface of the contact narrowed portion 75.

In this way, by forming the contact grooves 74 in the surface of the contact narrowed portion 75 which is narrower than the contact section 71 and the board connecting section 72, a water penetration route along the surface of the contact 70 is narrowed to limit an amount of entering water. Thereby, with the contact grooves 74, the waterproof property can be improved effectively.

It should be noted that instead of the contact grooves 74, a contact protrusion having such a shape as shown in FIGS. 25(A) to 25(D) may be formed on the contact narrowed portion 75.

In addition, for the contact 20 or 70, instead of performing waterproofing between the housing 10 and the contact 20 or 70 by forming the contact grooves 24 or 74, or a contact protrusion in the housing holding section 23 or 73 to be embedded in the housing 10, a waterproof effect can also be obtained, for example, by attaching a waterproof rubber to the contact to seal between the housing and the contact, or by using a potting material to seal between the housing and the contact, or the like.

In this regard, if the contact groove or the contact protrusion is formed in the housing holding section of the contact and then integral molding is carried out, the waterproof rubber attaching process and potting material applying process can be eliminated, thereby reducing cost, as well as eliminating a possibility of product damage due to potting materials adhered to a place other than those intended.

Embodiment 6

Figure 27:
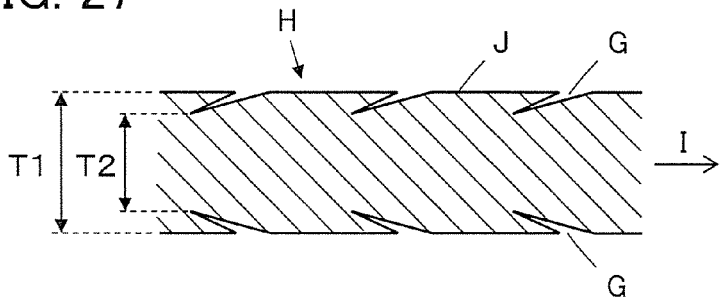
FIG. 27 is a cross-sectional view showing a shell waterproof shaped section used in a waterproof connector according to Embodiment 6.
Figure 28:
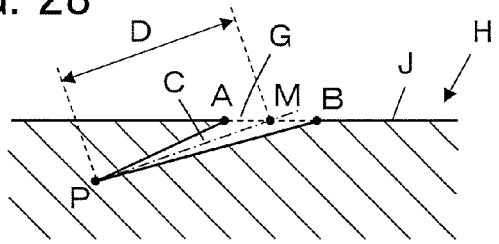
FIG. 28 is a partially enlarged cross-sectional view showing a waterproof groove used in the waterproof connector according to Embodiment 6.

As the shell grooves 34, 54, 64 and 65 and the contact grooves 24 and 74 in Embodiments 1 to 3 and 5, as shown in FIG. 27, a waterproof groove G which is cut in a direction diagonal instead of perpendicular, with respect to a surface J of a housing holding section H may be used. As shown in FIG. 28, assuming that a center line C of the waterproof groove G is defined by a straight line extending from a midpoint M between both end sections A and B of an opening of the waterproof groove G at the surface J of the housing holding section H to a bottom section P of the waterproof groove G, the waterproof groove G is formed so that the center line C from the opening section in the cross-sectional shape to the bottom section extends diagonally in a depth direction with respect to the surface J of the housing holding section H. Here, the length of a line segment MP defined by the midpoint M between both end sections A and B of the opening of the waterproof groove G and the bottom section P of the waterproof groove G will be called the groove depth D of the waterproof groove G. In order to block the entry of water along the interface between the housing holding section H and the housing covering the housing holding section H, the groove depth D preferably has a value of 0.01 mm or more.

As shown in FIG. 27, although due to the formation of the waterproof groove G, the thickness T2 of a portion in which the waterproof groove G is formed, becomes thinner than the thickness T1 of the portion in which no waterproof groove G is formed, by cutting the waterproof groove G in a diagonal direction with respect to the surface J of the housing holding section H, the thinning amount of the thickness T2 can be minimized compared to the case in which a groove of the same groove depth is formed perpendicular to the surface J of the housing holding section H. That is, with suppressing the reduction of the cross-sectional area of the housing holding section H of the conductive member as seen from the direction in which current I flows, the waterproof groove G of the same groove depth can be formed. Thereby, an increase in electric resistance due to the reduction of the cross-sectional area can be suppressed, and thus temperature rise during operation can be suppressed, while ensuring the groove depth necessary for the waterproofing.

In addition, since the waterproof groove G is cut diagonally so that the center line C from the opening section to the bottom section in the cross-sectional shape extends diagonally in a depth direction, a reduction of the cross-sectional area as seen from the direction in which current flows can be suppressed, while ensuring the groove depth necessary for waterproofing, and a reduction in the stiffness of the shell and the contact due to the formation of waterproof groove G can be suppressed. As a result, the connector assembling process can be performed with higher efficiency.

Such a waterproof groove G may be formed using mechanical processes such as laser machining, press working and grinding, or chemical processes, such as etching.

Figure 29:
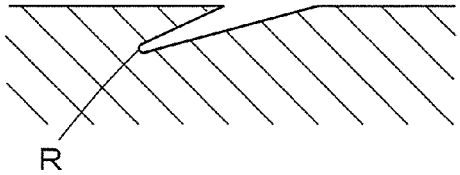
FIG. 29 is a partially enlarged cross-sectional view showing a waterproof groove used in a waterproof connector according to Modification 1 of Embodiment 6.

While the waterproof groove G shown in FIG. 28 has a sharp groove bottom section P, it may have a groove bottom section R with a rounded or curbed surface, for example, as shown in FIG. 29. Owing to such a rounded groove bottom section R, the stiffness of the shell and the contact in which the waterproof groove G is formed is further increased, thereby the efficiency in connector assembling process can be improved.

It is not necessary for the waterproof groove G cut in a diagonal direction with respect to the surface J of the housing holding section H, to enclose the entire periphery of the housing holding section H, and a waterproof effect can be obtained even by forming it in one portion along the periphery of the housing holding section H. In this regard, however, a more excellent waterproof capability can be exerted if the waterproof groove G is formed so as to surround and enclose the housing holding section H.

Preferably, the waterproof groove G is formed in each of the surfaces of the housing holding section H that are in contact with the housing. Once configured as such, the entry of water through any of the surfaces of the housing holding section H that are in contact with the housing can be blocked by the waterproof groove G formed in that surface.

Figure 30:
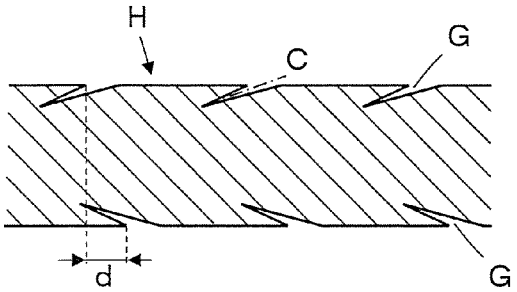
FIG. 30 is a partial cross-sectional view showing a waterproof shaped section used in a waterproof connector according to Modification 2 of Embodiment 6.

In this case, the waterproof groove G may be formed at the same location in each surface of the housing holding section H, as shown in FIG. 27, or the waterproof groove G may be formed at locations different between surfaces of the housing holding section H by a displacement by an amount of displacement d, as shown in FIG. 30. In addition, while in FIG. 27, the center line C of the waterproof groove G is inclined in the same direction with respect to each surface of the housing holding section H, the waterproof groove G may be formed such that the center line C of the waterproof groove G is inclined in different directions with respect to different surfaces of the housing holding section H, as shown in FIG. 31.

In this way, by displacing the waterproof groove G formed, depending on the surface of the housing holding section H, or by inclining the center line C of the waterproof groove G in different directions, depending on the surface of the housing holding section H, a decrease in the cross-sectional area of the shell and the contact as seen from the direction in which current flows is further suppressed, which allows a further suppression of an increase in electric resistance and a reduction in stiffness of the shell and the contact due to the formation of the waterproof groove G.

Figure 31:
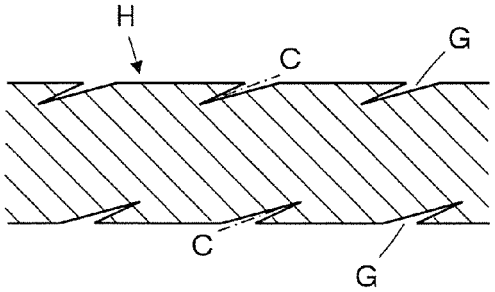
FIG. 31 is a partial cross-sectional view showing a waterproof shaped section used in a waterproof connector according to Modification 3 of Embodiment 6.
Figure 32:
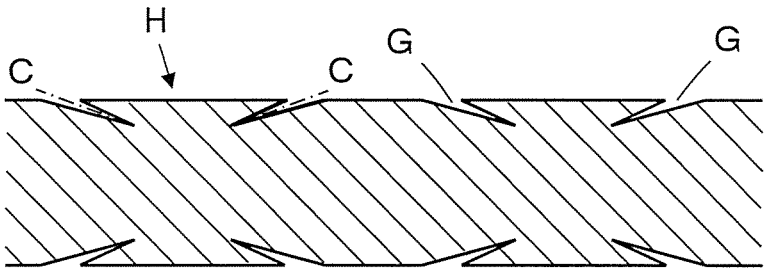
FIG. 32 is a partial cross-sectional view showing a waterproof shaped section used in a waterproof connector according to Modification 4 of Embodiment 6.

Also, while in the housing holding section H shown in any of FIGS. 27, 30 and 31, the center lines C of the plural waterproof grooves G formed in one surface of the housing holding section H, are inclined in the same direction, the present invention is not limited to this. As shown in FIG. 32, the waterproof grooves G formed in one surface of the housing holding section H may include plural waterproof grooves G having center lines C inclined in different directions.

In this way, by forming plural waterproof grooves G cut in different diagonal directions, in one surface of the housing holding section H, the separation between the insulating resin of the housing and the housing holding section H is less likely to occur irrespective of the direction where a possible stress is applied between the housing and the housing holding section H due to so-called ill fitting or the like, allowing the waterproof property to be further improved.

Figure 33:
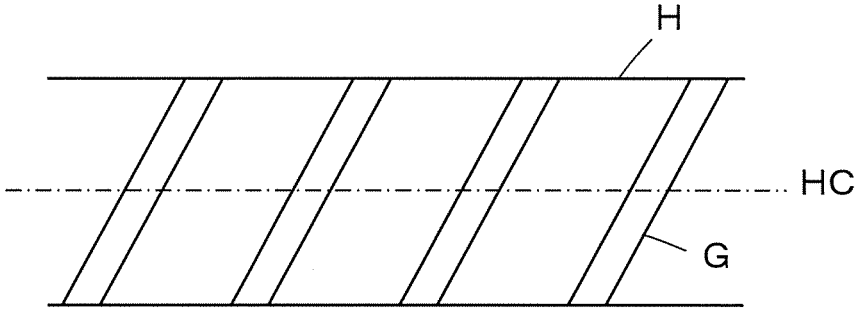
FIG. 33 is a partial plan view showing a waterproof shaped section used in a waterproof connector according to another embodiment.
Figure 34:
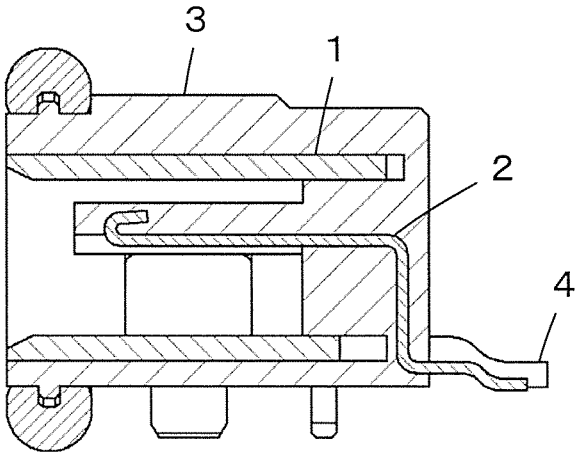
FIG. 34 is a side cross-sectional view showing a configuration of a prior art waterproof connector.

In each of the above described Embodiments, for example, as shown in FIG. 4, 7, 19 or the like, the opening section of the waterproof groove is so formed as to extend at the surface of the housing holding section in a direction perpendicular to the central axis of the housing holding section. The present invention is not limited to this and as shown in FIG. 33, the opening section of the waterproof groove G may be so formed as to extend at the surface of the housing holding section H diagonally with respect to the central axis HC of the housing holding section H.

In addition, while in the above described Embodiments 1 to 3, the shell and the contact are molded integrally with the housing, and waterproof grooves are formed in the housing holding sections of both of the shell and the contact, the present invention is not limited to this, and in some cases, the waterproof groove may be formed in the housing holding section of either one of the shell and the contact. In this regard, however, if the waterproof grooves are formed in both of the shell and the contact, a more excellent waterproof capability can be exerted.

Further, the waterproof grooves may be formed in the housing holding section of one or more contacts of a connector having no shell.

REFERENCE SIGNS LIST

1, Shell; 2, contact; 3, housing; 4, ground terminal; 10, housing; 10*a*, front surface; 10*b*, back surface; 10*c*, lower surface; 20, 70, contact; 21, 71, contact section; 22, 72, board connecting section; 23, 73, housing holding section of a contact; 24, 74, contact groove; 30, 50, 60, shell; 31, 51, 61, fitting section; 31*a*, upper surface of a fitting section; 32, 52, 62, board attachment section; 33, 53, 63, housing holding section of a shell; 33*a*, 53*a*, backward projecting section; 33*b*, 53*b*, arm section; 33*c*, 53*c*, leg section; 34, 54, 64, 65, shell groove; 35, metal plate; 35*a*, belt shaped section; 35*b*, flat plate section; 40, enclosure; 41, board; 42, opening section; 43, gasket; 44, grounding pattern; 45, wiring pattern; 75, contact narrowed portion; S, space; C1, central axis of a fitting section of a shell; H, housing holding section; J, surface of a housing holding section; G, waterproof groove; C, center line of a waterproof groove; P, R, groove bottom section; d, amount of displacement; HC, central axis of a housing holding section.

The invention claimed is:

1. A waterproof connector adapted to be mounted on a board and to be fitted to a mating connector, the waterproof connector comprising:

a housing made of an insulating resin;

a shell molded integrally with the housing; and at least one contact molded integrally with the housing, the shell having:

a fitting section which is exposed from the housing and fits to the mating connector;

a board attachment section which is exposed from the housing and is attached to the board; and a housing holding section which connects between the fitting section and the board attachment section, and which is embedded in the housing, wherein a shell waterproof shaped section is formed at a surface of the housing holding section so as to block entry of water along an interface between the housing holding section and the housing.

2. The waterproof connector according to claim 1, wherein the shell waterproof shaped section comprises one or more shell waterproof grooves so formed as to separate the surface of the housing holding section into a part at a side of the fitting section and a part at a side of the board attachment section.

3. The waterproof connector according to claim 2, wherein the shell waterproof grooves are so foamed as to surround the housing holding section and close themselves.

4. The waterproof connector according to claim 2, wherein the shell waterproof grooves each have a groove depth of 0.01 mm or more.

5. The waterproof connector according to claim 2, wherein the shell waterproof grooves have a cross section which is triangular, arced, quadrangular or inverted triangular.

6. The waterproof connector according to claim 5, wherein the shell waterproof grooves are formed in each of surfaces of the housing holding section that are in contact with the housing.

7. The waterproof connector according to claim 5, wherein the shell waterproof shaped section has the shell waterproof grooves which are at least two in number and are formed in one surface of the housing holding section.

8. The waterproof connector according to claim 5, wherein the shell waterproof grooves have an opening extending at a surface of the housing holding section in a direction perpendicular to a central axis of the housing holding section.

9. The waterproof connector according to claim 5, wherein the shell waterproof grooves have an opening extending at a surface of the housing holding section obliquely to a central axis of the housing holding section.

10. The waterproof connector according to claim 1, wherein the shell waterproof shaped section comprises one or more shell waterproof protrusions so formed as to separate the surface of the housing holding section into a part at a side of the mating connector connecting section and a part at a side of the board attachment section.

11. The waterproof connector according to claim 10, wherein the shell waterproof protrusions are so formed as to surround the housing holding section and close themselves.

12. The waterproof connector according to claim 10, wherein the shell waterproof protrusions each have a relative height of 0.01 mm or more.

13. The waterproof connector according to claim 10, wherein the shell waterproof protrusions have a cross section which is triangular, arced, quadrangular or inverted triangular.

14. The waterproof connector according to claim 13, wherein the shell waterproof protrusions are formed on each of surfaces of the housing holding section that are in contact with the housing.

15. The waterproof connector according to claim 13, wherein the shell waterproof shaped section has the shell waterproof protrusions which are at least two in number and are formed on one surface of the housing holding section.

16. The waterproof connector according to claim 1, wherein:

the housing holding section includes a shell narrowed portion which is formed narrower than the fitting section; and the shell waterproof shaped section is formed at a surface of the shell narrowed portion.

17. The waterproof connector according to claim 1, wherein:

the housing holding section has a hollow shape; and the shell waterproof shaped section is formed at each of outer and inner periphery surfaces of the housing holding section.

18. The waterproof connector according to claim 1, wherein:

the contact has:

a connection section which is exposed inside the fitting section of the shell;

a board mounting section which is exposed from the housing and is mounted to the board; and a housing fixing section which connects between the connection section and the board mounting section, and which is embedded in the housing, and wherein a contact waterproof shaped section is formed at a surface of the housing fixing section so as to block entry of water along an interface between the housing fixing section and the housing.

19. The waterproof connector according to claim 18, wherein:

the housing fixing section includes a contact narrowed portion which is formed narrower than the connection section and the board mounting section; and the contact waterproof shaped section is formed at a surface of the contact narrowed portion.

20. A waterproof connector adapted to be mounted on a board and to be fitted to a mating connector, the waterproof connector comprising:

a housing made of an insulating resin; and at least one conductive member molded integrally with the housing, the conductive member having:

a mating connector connecting section which is exposed from the housing and is connected to the mating connector;

a board attachment section which is exposed from the housing and is attached to the board; and a housing holding section which connects between the mating connector connecting section and the board attachment section, and which is embedded in the housing, wherein the housing holding section includes a flat section having a flat surface and a waterproof shaped section located adjacent to the flat section, the waterproof shaped section having one or more waterproof grooves so formed as to surround the housing holding section and close themselves to block entry of water along an interface between the housing holding section and the housing, and wherein the waterproof grooves have a triangular cross section, and a center line of each waterproof groove extending in the cross section from an opening to a bottom of the waterproof groove in a depth direction is oblique to the flat surface of the flat section.

21. The waterproof connector according to claim 20, wherein the waterproof grooves each have a groove depth of 0.01 mm or more.

22. The waterproof connector according to claim 20, wherein the waterproof grooves each have a rounded groove bottom.

23. The waterproof connector according to claim 20, wherein the waterproof grooves are formed in each of surfaces of the housing holding section that are in contact with the housing.

24. The waterproof connector according to claim 23, wherein the waterproof grooves are at least two in number, are formed in plural surfaces of the housing holding section, and are identical to each other in direction where the center line is inclined with respect to a corresponding surface of the housing holding section.

25. The waterproof connector according to claim 23, wherein the waterproof grooves are at least two in number, are formed in plural surfaces of the housing holding section, and include the waterproof grooves which are different from each other in direction where the center line is inclined with respect to a corresponding surface of the housing holding section.

26. The waterproof connector according to claim 20, wherein the waterproof shaped section has the waterproof grooves which are at least two in number and are formed in one surface of the housing holding section.

27. The waterproof connector according to claim 26, wherein the waterproof grooves formed in one surface of the housing holding section are identical to each other in direction where the center line is inclined with respect to the surface of the housing holding section.

28. The waterproof connector according to claim 26, wherein the waterproof grooves formed in one surface of the housing holding section include the waterproof grooves which are different from each other in direction where the center line is inclined with respect to the surface of the housing holding section.

29. The waterproof connector according to claim 20, wherein the waterproof grooves have an opening extending at a surface of the housing holding section in a direction perpendicular to a central axis of the housing holding section.

30. The waterproof connector according to claim 20, wherein the waterproof grooves have an opening extending at a surface of the housing holding section obliquely to a central axis of the housing holding section.

31. The waterproof connector according to claim 20, comprising a shell as the conductive member, wherein:

the shell has a fitting section, as the mating connector connecting section, which fits to the mating connector;

the shell has a shell narrowed portion in the housing holding section which is formed narrower than the fitting section; and the waterproof shaped section is formed at a surface of the shell narrowed portion.

32. The waterproof connector according to claim 20, comprising a shell as the conductive member, wherein:

the shell has a fitting section, as the mating connector connecting section, which fits to the mating connector;

the housing holding section has a hollow shape; and the waterproof shaped section is formed at each of outer and inner periphery surfaces of the housing holding section.

33. The waterproof connector according to claim 20, comprising one or more contacts as the conductive member, wherein:

each of the contacts has a connection section, as the mating connector connecting section, which comes into contact with a contact of the mating connector, each of the contacts has a contact narrowed portion in the housing holding section which is formed narrower than the connection section and the board attachment section; and the waterproof shaped section is formed at a surface of the contact narrowed portion.

34. The waterproof connector according to claim 20, comprising a shell and one or more contacts as the conductive member, wherein the waterproof shaped section is formed at each of the shell and the one or more contacts.

* * * * *